United States Patent [19]

Knorowski et al.

[11] Patent Number: 4,682,934

[45] Date of Patent: Jul. 28, 1987

[54] WHEEL ANTI-ROTATION MEANS

[75] Inventors: Victor J. Knorowski, Rexford; Charles R. Hean, Clifton Park; Ronald J. Placek, Schenectady, all of N.Y.

[73] Assignee: General Electric Company, Schenectady, N.Y.

[21] Appl. No.: 806,072

[22] Filed: Dec. 6, 1985

[51] Int. Cl.[4] ..... F01D 5/06

[52] U.S. Cl. ..... 416/198 A; 416/200 A; 416/244 A

[58] Field of Search ..... 416/198 A, 200 A, 201 R, 416/244 A; 415/199.5

[56] References Cited

U.S. PATENT DOCUMENTS

| | | | |
|---|---|---|---|
| 1,107,238 | 8/1914 | Kieser | 416/198 A |
| 1,873,956 | 8/1932 | Dahlstrand | 416/198 A X |
| 2,654,565 | 10/1953 | Feilden | 416/198 A X |
| 3,680,979 | 8/1972 | Hansen et al. | 416/199 X |
| 3,749,516 | 7/1973 | Samurin et al. | 416/199 |
| 4,029,437 | 6/1977 | Aubry et al. | 416/198 A |
| 4,247,256 | 1/1981 | Maghon | 416/198 A |
| 4,330,236 | 5/1982 | Le Breton | 416/198 A |
| 4,477,227 | 10/1984 | Klufas | 416/198 A |
| 4,497,612 | 2/1985 | Knorowski et al. | 416/198 A |
| 4,509,900 | 4/1985 | Odawara | 416/198 A |
| 4,537,560 | 8/1985 | Emeterio et al. | 416/198 A |
| 4,573,875 | 3/1986 | Emeterio et al. | 416/198 A |

FOREIGN PATENT DOCUMENTS

| | | | |
|---|---|---|---|
| 85205 | 7/1978 | Japan | 416/201 R |
| 128809 | 10/1979 | Japan | 416/199 |
| 697752 | 9/1953 | United Kingdom | 416/201 R |

*Primary Examiner*—Everette A. Powell, Jr.

*Attorney, Agent, or Firm*—Jerome C. Squillaro

[57] ABSTRACT

An anti-rotation device for preventing rotation of a wheel with respect to a shaft, wherein the wheel is primarily secured to the shaft by an interference shrink fit, should the interference shrink fit loosen, comprises an annular member separate from yet irrotatably secured to the periphery of the shaft, such as by an interference shrink fit, and a pair of spaced apart restraining tabs coupled to the annular member for receiving a portion of the wheel therebetween. A portion of the radial inner surface of the member may be outwardly tapered toward an axial end to assist dispersion of fluid which may accumulate in the region of the anti-rotation device. The device may include spacing protrusions for axially spacing the device from the wheel and may be disposed between a pair of wheels for preventing undesirable rotation of one or both wheels.

30 Claims, 5 Drawing Figures

WHEEL ANTI-ROTATION MEANS

BACKGROUND OF THE INVENTION

This invention relates to wheel anti-rotation means and, more particularly, to an auxiliary means for restraining a wheel against rotation with respect to a shaft and/or other wheels secured to the shaft when a primary means for securing the wheel to the shaft is disturbed. Related to the present invention is U.S. Pat. No. 4,497,612—Knorowski et al which is incorporated herein by reference thereto.

The invention will be described as it may be applied to a steam turbine. However, the invention may be used with any type of rotating machinery wherein it is desired to provide an auxiliary or backup means for securing a wheel against undesirable rotation with respect to a shaft to which it is secured and/or with respect to other wheels secured to the shaft.

Some steam turbines utilize rotors wherein the turbine wheels that carry turbine blades at their radially outermost portions are not an integral part of the shaft of the rotor. In addition to the turbine blades, each wheel includes a hub section generally disposed at its radially inward portion which has a bore therethrough for receiving the shaft of the rotor. Typically the wheel may be secured to the shaft of the rotor by an interference shrink fit between the radially inner surface of the hub section defining the bore and a corresponding peripheral surface of the shaft. During normal turbine operations, this interference fit prevents rotation of the wheel with respect to the shaft and/or other wheels secured to the shaft.

In order to maintain efficiency and mechanical integrity of the turbine, it is necessary that the wheels, and thereby the turbine blades, be maintained at a substantially fixed position relative to the shaft and relative to other wheels secured to the shaft. This requirement should be met during all turbine operations, including normal but non-steady state conditions, such as overspeed and undesirable thermal transient periods. To ensure that the turbine wheels do not rotate relative to the shaft and/or other wheels secured to the shaft during such turbine operations, anti-rotation means may be included with the shaft for augmenting the primary means, such as an interference shrink fit, for securing a wheel to the shaft and for inhibiting rotation of a wheel with respect to the shaft and/or other wheels secured to the shaft should the primary securing means loosen or be otherwise compromised.

One system for providing auxiliary means for securing a wheel to a shaft is disclosed and claimed in the aforementioned U.S. Pat. No. 4,497,612—Knorowski et al, which is assigned to the present assignee. One of the features of the system of the Knorowski et al patent is an axially extending groove cut into the periphery of the shaft. In certain applications, it may be desirable not to have to machine the peripheral surface of the shaft to include this axial groove. In addition, as discussed in detail in the Knorowski et al patent, any anti-rotation means to be used should minimize stresses in the wheel, shaft and anti-rotation means itself.

Accordingly, it is an object of the present invention to provide anti-rotation means for securing a wheel against undesirable rotation with respect to the shaft and/or other wheels secured to the shaft without having to fabricate an axially extending groove in the periphery of the shaft.

Another object of the present invention is to provide anti-rotation means in which stress concentration factors in the anti-rotation means and in the region around the anti-rotation means and the shaft is minimized.

SUMMARY OF THE INVENTION

In accordance with the present invention, in an axial fluid flow turbine, anti-rotation means for securing a wheel to be disposed about a first surface portion of the periphery of a rotatable shaft of the turbine for preventing rotation of the wheel with respect to the shaft comprises locking means discrete from yet irrotatably affixed to a second surface portion of the periphery of the shaft and restraining means affixed to the locking means for fixedly engaging at least a portion of the wheel, whereby rotation of the wheel with respect to the shaft is prevented.

In one embodiment of the present invention, the locking means include an annular member or ring surrounding the second surface portion of the shaft and having a radially inner surface irrotatably affixed to the second surface portion, such as by an interference shrink fit. The restraining means include a pair of circumferentially spaced apart ribs affixed to the periphery of the annular member, outwardly extending from the member to form an axially extending channel therebetween. In order to reduce stress concentration between the interface of the periphery of the shaft and the radially inner surface of the annular member, the second surface portion of the shaft is bounded by a pair of parallel axially spaced apart circumferential grooves disposed in the surface of the shaft, and the axial ends of the radially inner surface of the member are extended to overhang the circumferential grooves so that no tensile spike exists along the interface between the radially inner surface of the member and the second surface portion of the shaft. Further, in order to assist dispersion of any fluid which may tend to accumulate in the region of the annular member, the radially inner surface of the annular member is radially outwardly tapered toward each respective axial end. In addition, spacing means may be secured to an axial end of the member for spacing the member from a wheel hub on the shaft.

In another aspect of the present invention, in an axial fluid flow turbine, a rotor comprises a rotatable shaft having a first peripheral surface with a first predetermined axial expanse, the first peripheral surface for irrotatably receiving a first wheel, such as by an interference shrink fit between a radially inner surface of the hub of the wheel and the first peripheral surface of the shaft, the shaft further having a second peripheral surface with a second predetermined axial expanse. Locking means, such as an annular member or ring, is discrete from yet irrotatably affixed to the second peripheral surface of the shaft, such as by an interference shrink fit, and restraining means is affixed to the locking means for fixedly engaging at least a portion of the wheel, whereby rotation of the wheel with respect to the shaft is prevented.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
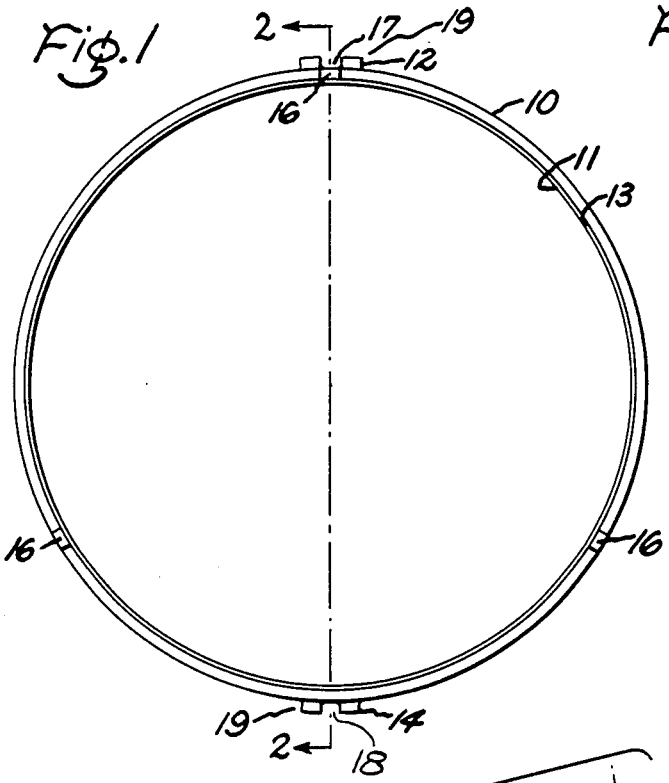
FIG. 1 is an axial end view of anti-rotation means in accordance with the present invention.

Referring to FIG. 1, an axial end view of anti-rotation means in accordance with the present invention is shown. Anti-rotation means comprises locking means 10, such as an annular member or collar, having at least one restraining means 19, such as a pair of circumferentially spaced apart, outwardly radially extending ribs 12, affixed to the outer periphery of member 10, for forming an axially extending channel 17 therebetween. Other restraining means 19, including outwardly radially extending ribs 14 therebetween, for forming an axially extending channel 18 are shown disposed diametrically opposed to restraining means 19. The positioning of other restraining means relative to restraining means 19, and indeed even the necessity of such other restraining means, is determined by forces which are expected to be restrained by the restraining means should the primary means for securing a wheel to a shaft be disturbed. It is preferable that restraining means 19 be fabricated integral annular member 10, and not be fixedly secured thereto such as by welding, in order to minimize stress concentration factors within annular member 10 and restraining means 19. In addition, in order to reduce stress concentration factors in the region of restraining means 19 and channel 17, it is preferred that restraining means 19 outwardly extend from the major portion of the body of annular member 10 and away from the major circumferential stress field internal to member 10, rather than include an axial groove recessed into the periphery of member 10 for forming channel 17, such that the axial groove would extend into the major circumferential stress field of member 10. Spacer means 16, such as a plurality of arcuately spaced apart axial extensions, axially extend from annular member 10 for appropriately axially spacing member 10 from an adjacent wheel while permitting fluid flow over the axial end of annular member 10 between protrusions 16. Annular member 10 further includes an inner radial surface 11 for cooperating with and for irrotatably mating with an appropriate peripheral surface of a shaft.

Figure 2:
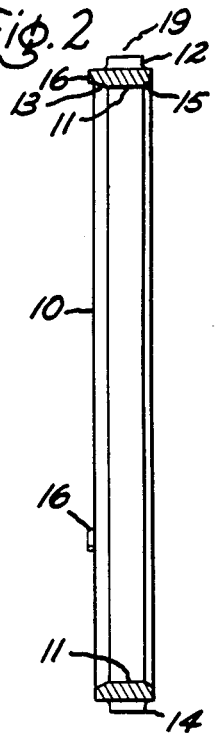
FIG. 2 is a view looking in the direction of the arrows of line 2—2 of FIG. 1.

Referring to FIG. 2, a view looking in the direction of the arrows of line 2—2 of FIG. 1 is shown. The axial ends of radially inner surface 11 of annular member 10 are radially outwardly tapered at 13 and 15, respectively. The purpose and function of tapers 13 and 15 will be described in detail below.

Figure 3:
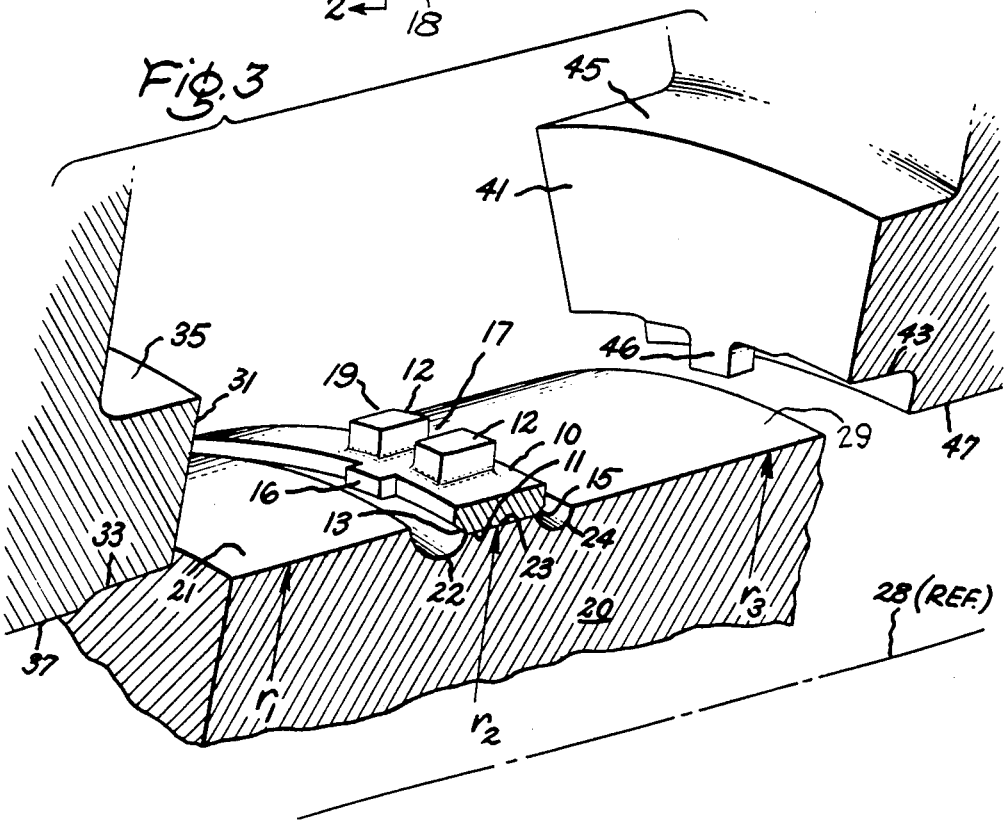
FIG. 3 is an exploded assembly view of a portion of a shaft, a pair of wheels and anti-rotation means in accordance with the present invention.

Referring to FIG. 3, an exploded assembly view including a portion of two wheels, the shaft and anti-rotation means in accordance with the present invention, is shown. Turbine wheel 35 includes a plurality of turbine blades, or buckets, (not shown) disposed at an outer radial portion thereof and a hub 31 disposed at a generally radially inner portion of wheel 35 and having an axial bore therethrough defined by radially inner surface 37 of hub 31. Bore surface 37 terminates at shoulder 33 of wheel 35, wherein shoulder 33 is radially outwardly relieved from surface 37. Likewise, wheel 45 includes a plurality of turbine blades, or buckets, (not shown) disposed at a generally radially outer portion thereof and a hub portion 41 disposed at a generally radially inner portion thereof, wherein hub 41 includes a surface 47 defining an axial bore therethrough. Bore surface 47 terminates in shoulder 43 of wheel 45, wherein shoulder 43 is radially outwardly relieved from surface 47. Engaging means 46, such as a radially inwardly extending member or tab, is fixedly coupled to, and preferably integral with, shoulder 43 of wheel 45 for engaging at least one rib 12 when tab 46 is disposed in channel 17. Similar engaging means (not visable in FIG. 3) is fixedly coupled to shoulder 33 of wheel 35.

A shaft 20 includes a peripheral surface 21 having a predetermined axial extent for irrotatably engaging surface 37 of wheel 35, such as by an interference shrink fit, and another peripheral surface 29 having a predetermined axial extent for irrotatably engaging bore surface 47 of wheel 45, such as by an interference shrink fit.

Shaft 20 further includes yet another peripheral surface 23 having a predetermined axial extent and disposed between surfaces 21 and 29 of shaft 20. Surfaces 21, 23 and 29 of shaft 20 have a respective substantially uniform radius over their axial expanse. Locking means 10 is irrotatably secured to surface 23 such as by an interference shrink fit. A pair of circumferentially extending parallel grooves 22 and 24 may be respectively disposed between surface 21 and 23 of shaft 20 and between surface 23 and 29 of shaft 20 for respectively assisting fluid removal from the region of locking means 10 and surface 23. Ribs 12 are circumferentially spaced apart so that engaging means 46 may be positioned in channel 17 when wheel 45 is assembled onto surface 29 of shaft 20. Likewise the engaging means (not seen in FIG. 3) from shoulder 33 of wheel 35 may be concurrently disposed in channel 17 when wheel 35 is assembled onto surface 21 of shaft 20.

A line 28 which is parallel to the axis of rotation of shaft 20 is shown for reference. Typically, wheel receiving surfaces 21 and 29 of shaft 20 may be stepped, i.e. have a different respective radial dimension from the axis of rotation of shaft 20. Two common configurations for stepping wheel receiving surfaces of shaft 20 include: disposing wheel receiving surfaces having a respective greater radial dimension from one axial end toward the other axial end of shaft 20, and disposing wheel receiving surfaces having a respective greater radial dimension from each axial end of shaft 20 toward a generally central location of shaft 20 at which location wheel surfaces having the greatest radial dimension are disposed. Thus, the radial dimension $r_1$ of surface 21 is larger than the radial dimension $r_3$ of surface 29. Radial dimension $r_2$ of surface 23 may preferably lie in the range of equal to or less than radial dimension $r_1$ to slightly less than radial dimension $r_3$. This facilitates fabrication of surface 23 especially if radial dimension $r_2$ is equal to radial dimension $r_1$, or $r_3$, since, for example, in a lathe for turning surface 23, the setting of the lathe would not have to be readjusted for machining two of surfaces 21, 23 and 29. Radial dimension $r_2$ is selected so that when annular member 10 is securely fixed to surface 23 of shaft 20, the radially outer surface of annular member 10 can fit under and be radially spaced from shoulders 33 and 43 of wheels 35 and 45, respectively. Further, radial dimension $r_2$ is selected so that when annular member 10 has a radial cross section dimension, or radial profile, adequate for providing appropriate strength to member 10 for restraining motion of wheel 45 and/or 35 with respect to each other and/or with respect to shaft 20. Radial dimension $r_2$ must not be so small as to cause undesirable stress in or weaken shaft 20 in the region of surface 23.

Figure 4:
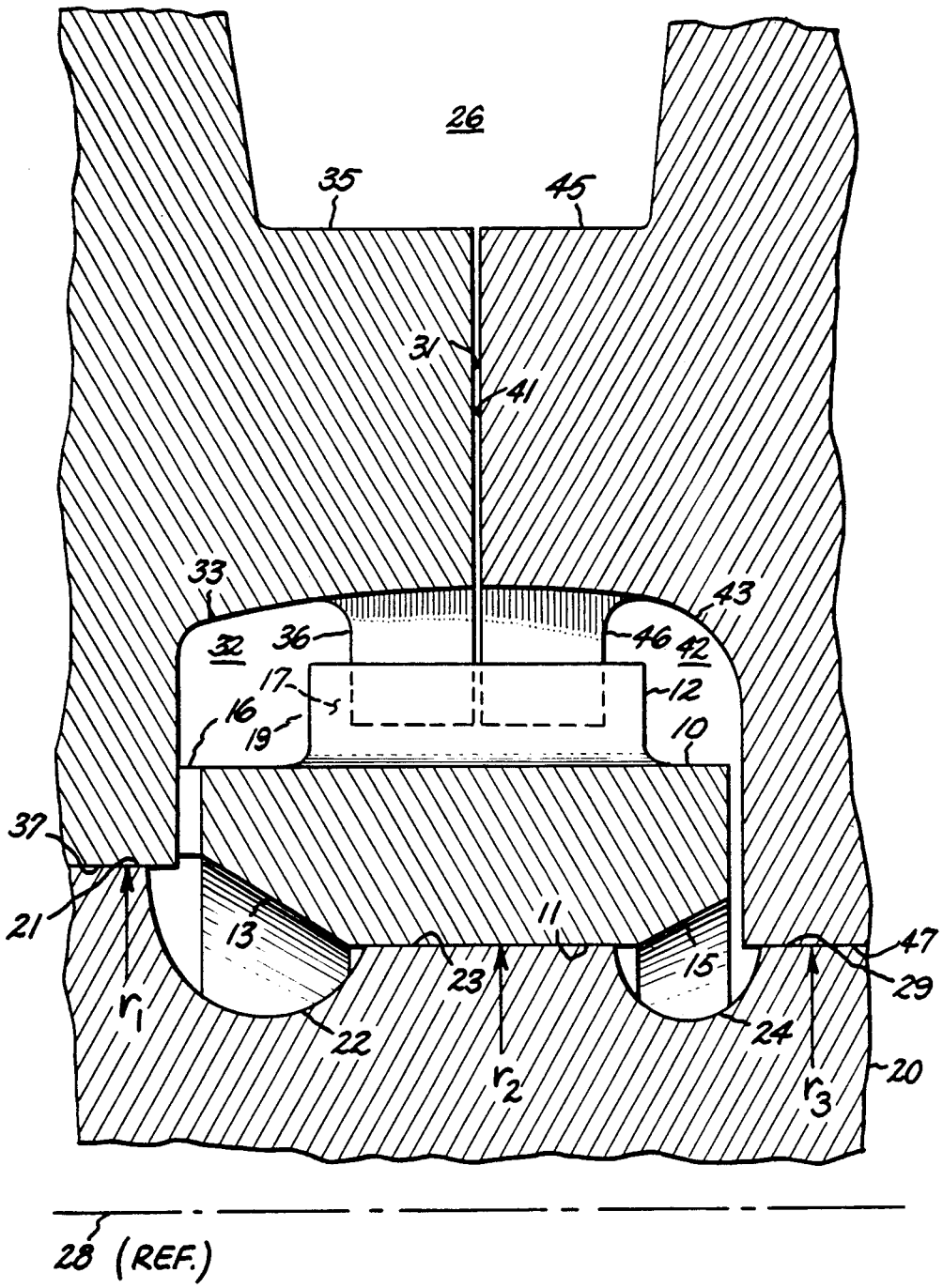
FIG. 4 is a partial sectional elevational plan view showing components of FIG. 3 in their assembled position.

Referring to FIG. 4, a partial sectional elevational plan view with components of FIG. 3 in their assembled position is shown. The term rotor may be used to refer to shaft 20 having wheels 35 and 45 and locking means 10 operationally assembled thereon. Wheels 35 and 45 are shown secured to shaft 20 by an inteference shrink fit between respective bore surfaces 37 and 47 and respective shaft surfaces 21 and 29. Annular member 10 is irrotatably secured to shaft 20 by an interference shrink fit between radially inner surface 11 of member 10 and surface 23 of shaft 20. Respective tabs 36 and 46 of wheels 35 and 45 are disposed in channel 17 and adequately radially inwardly extend toward the outer peripheral surface of member 10 such that tab 36 and 46 will contact restraining means 19, and be irrotatably secured thereby, should the interference shrink fit between surfaces 37 and 21 and/or 47 and 29 loosen. Preferably, wheels 35 and 45 are assembled onto shaft 20 such that tab 36 and 46 abut rib 12 which is leading when shaft 20 is rotating. When shaft 20 is rotating, a first element is considered to be leading with respect to a second element when the first element passes a fixed point before the second element.

During assembly, wheel 35, having a larger bore therethrough as defined by surface 37 than does wheel 45 as defined by surface 47, is assembled first onto surface 21 of shaft 20. Annular ring 10 is then assembled onto surface 23 of shaft 20 with tab 36 disposed in channel 17, and is axially positioned such that spacing means 16 contact the inner axial end of shoulder 33, or a corresponding region of hub portion 31, of wheel 35 for readily accurately axially spacing member 10 from wheel 35. By appropriately sizing the axial extent of spacer means 16, annular member 10 may be assembled onto shaft 20 without having to measure the axial distance between annular member 10 and the inner axial end of shoulder 33. Member 10 is thus spaced from wheel 35 for forming a fluid flow path between the volume encompassed in part by groove 22 and a circumferential channel 32 defined in part by shoulder 33. Wheel 45 is then assembled onto surface 29 of shaft 20 with tab 46 disposed in channel 17, such that the inner axial end of shoulder 43, or a corresponding region of hub portion 41, is axially spaced from annular member 10 for forming a fluid flow path between the volume encompassed in part by groove 24 and a circumferential channel 42 defined in part by shoulder 43. Wheel 35 is also spaced from wheel 45. Thus, channel 32 and 42 are in fluid flow communication with region 26 at the radial outer portion of wheels 35 and 45 through the space between hub 31 and 41.

Dispersion means includes axial end portions 13 and 15 of inner radial surface 11 of annular member 10 that are respectively outwardly tapered, thus defining a part of the surface of a frustum of a cone, so that when shaft 20 is rotating, any liquid accumulation in the area of circumferential groove 22 and 24 will be directed toward the radially outer portion of shoulders 33 and 43 and eventually between hubs 31 and 41 of wheels 35 and 45 toward radially outer region 26 of the turbine from which it may be readily dispersed. Axially end portions 13 and 15 may define any contour which directs fluid axially beyond respective axial ends of member 10 when shaft 20 is rotating. Gases may also follow the same general path from grooves 22 and 24 to region 26.

Radially inner surface 11 of annular member 10 axially outwardly extends beyond the intersection of surface 11 with the margin of grooves 22 and 24 in order to minimize stress concentration factors in the region where taper 13 and 15 intersect radially inner surface 11 of annular member 10. Circumferential grooves 22 and 24, in cooperation with axial extensions of surface 11 of member 10 to overhang grooves 22 and 24, respectively displace the maximum bending stress location in shaft 20 axially beyond the intersection of grooves 22 and 24 with surface 23 of shaft 20, respectively, such that the maximum bending stress points for shaft 20 are respectively situated a predetermined distance along groove 22 and 24 from the respective intersection with surface 23. This avoids concurrence between the maximum bending stress points and a tensile spike which would exist if member 10 were disposed so that the end of surface 11 coincided with an axial end of surface 23 which then directly transitioned to a surface, such as surface 21 and/or 29, having a greater or lesser radius than surface 23. In addition, axially extending surface 11 of member 10 to overhang grooves 22 and 24 virtually eliminates any tensile spike in shaft 20 caused by member 10. If a tensile spike does exist in shaft 20, it will be greatly attenuated and be disposed at a point between the respective intersection of surface 11 with grooves 22 and 24 and the respective maximum bending stress point for shaft 20 so that the respective tensile spike and maximum bending stress point for shaft 20 do not coincide.

The interface between the base of ribs 12 and the radially outer surface of annular member 10 are preferably aerodynamically contoured to form streamlined fillets for reducing stress concentration factors in the region of ribs 12. Annular member 10 should comprise a material compatible with the material of shaft 20 and have about the same thermal expansion coefficient so that the diameter of member 10 expands about the same as the diameter of surface 23 of shaft 20. If the diameter of member 10 expands faster than the diameter of surface 23 of shaft 20, then the shrink fit between surface 11 and surface 23 will tend to loosen, and if the diameter of annular member 10 expands less than the diameter of surface 23 of shaft 20, then additional tensile forces created in member 10 may result in undesirable weakening and/or irreversible deformation of member 10. Further, the radial cross section area of annular member 10 is selected to avoid stresses near the yield point which may be applied thereto or formed therein, such as by tab 36 of wheel 35 should loosening of the interference shrink fit between surface 37 of wheel 35 and surface 21 of shaft 20 occur. An analogous stress may be applied by tab 46 of wheel 45 should loosening of the interference shrink fit between surface 47 of wheel 45 and surface 29 of shaft 20 occur.

In addition, the axial extent of surface 23 and radial dimension $r_2$ thereof, thereby determining the overall surface area of surface 23, are selected such that the interference shrink fit between radially inner surface 11 of annular member 10, or more specifically the surface area of surface 11, which contacts surface 23, is adequate to prevent annular member 10 from rotating with respect to shaft 20 regardless of the status of the primary means, e.g. interference shrink fit, for securing wheels 35 and/or 45 to shaft 20. The axial extent of surface 23 and radial dimension $r_2$ thereof are also selected such that shaft 20 withstands compressive forces from the interference shrink fit between member 10 and surface 23 without crushing a portion of shaft 20 in the region of surface 23. Thus member 10 has low internal stress concentrations and is independent of the main turbine shaft. Member 10 transfers torque from turbine wheels 35 and/or 45 to shaft 20 by use of an interference fit between member 10 and surface 23 of shaft 20. Because of the relatively small mass of member 10 with respect to the mass of wheel 35 and/or 45, which may typically be about 20–100 times less than the mass of wheel 35 for example, virtually no significant increase in internal stresses of member 10 within an operable speed range up to at least 3600 RPM are expected to be experienced.

Figure 5:
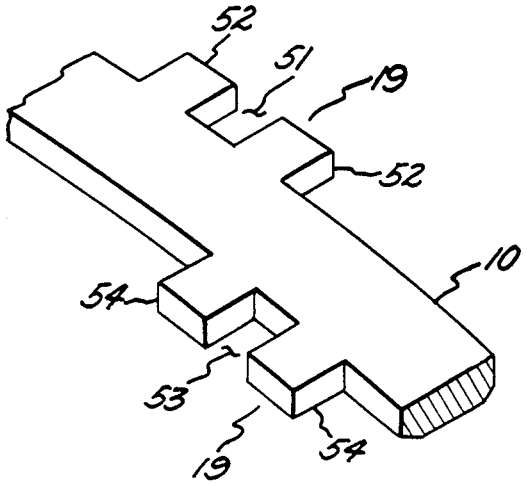
FIG. 5 is an alternate embodiment of anti-rotation means in accordance with the present invention.

Referring to FIG. 5, an alternate embodiment of a part of anti-rotation means in accordance with the present invention is shown. The anti-rotation means comprises locking means 10 and laterally extending restraining means 19 fixedly coupled thereto. Restraining means 19 include a pair of axially extending and respectively arcuately spaced apart ribs 52 and 54 which extend in opposite axial directions from locking means 10. Ribs 52 and 54 are preferably integral locking means 10, and not secured thereto such as by welding, in order to minimize stress concentration factors within locking means 10 and restraining means 19. Radially extending channels 51 and 53 are formed between ribs 52 and 54, respectively.

In order to reduce stress concentration factors in the region of restraining means 10 and channels 51 and 53, it is preferred that restraining means 19 outwardly extend from the major portion of the body of annular member 10 and away from the major circumferential stress field internal to member 10, rather than include a respective radial groove recessed into the lateral side of member 10 for forming channel 51 and 53, respectively, such that the radial groove would extend into the major circumferential stress field of member 10.

During assembly, channel 53 and 51 receive engaging means 36 and 46, respectively. Alternatively, engaging means 36 and/or 46 may axially outwardly extend (not shown) from shoulder 33 and 43, respectively. When laterally extending restraining means 19 are used, it is not necessary to employ spacing means 16 for readily spacing member 10 from shoulder 33. Ribs 54 are axially extended an appropriate distance from member 10 so that member 10 may be readily disposed and axially spaced from wheel 35 when ribs 54 contact hub 33 during assembly of the anti-rotation means onto shaft 20.

In order further to reduce stress concentration factors in locking means 10, it is preferable that ribs 52 and 54 not be axially aligned or registered. That is, ribs 52 and 54 should be arcuately displaced from each other, with engaging means 36 and 46 appropriately circumferentially disposed so as to cooperate with channel 53 and 51, respectively, wherein channel 51 and 53 do not axially coincide over their respective arcuate length.

Thus has been illustrated and described anti-rotation means for securing a wheel against undesirable rotation with respect to the shaft and/or other wheels secured to the shaft without having to fabricate an axially extending groove in the periphery of the shaft, while stress concentration factors in the anti-rotation means and in the region around the anti-rotation means and the shaft are minimized.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In an axial fluid flow turbine, anti-rotation means for securing a wheel to be disposed about a first surface portion of a rotatable shaft of the turbine, said anti-rotation means for preventing rotation of the wheel with respect to the shaft, said anti-rotation means comprising:

locking means including an annular member surrounding said shaft, said locking means discrete from yet irrotatably affixed to a second surface portion of the shaft; and, wherein the second surface portion has a predetermined axial expanse and further wherein said annular member includes a radially inner surface for irrotatably engaging the second surface portion, wherein the radially inner surface of the annular member axially extends beyond both axial ends of the second surface portion; and, restraining means affixed to said locking means, said restraining means for fixedly engaging a portion of the wheel, whereby rotation of the wheel with respect to the shaft is prevented.

2. Anti-rotation means as in claim 1, wherein said restraining means include a first pair of spaced apart ribs coupled to the periphery of said annular member and extending from said annular member, said first pair of ribs for receiving a tab of the wheel therebetween.

3. Anti-rotation means as in claim 2, wherein said first pair of ribs radially outwardly extend from said annular member.

4. Anti-rotation means as in claim 2, wherein said first pair of ribs axially extend in one axial direction from said annular member.

5. Anti-rotation means as in claim 4, further comprising a second pair of spaced apart ribs coupled to the periphery of said annular member, said second pair of ribs axially extending from the annular member in the other axial direction for engaging a portion of another wheel therebetween.

6. Anti-rotation means as in claim 5, wherein said first and second pair of tabs are disposed so as not to be axially aligned.

7. Anti-rotation means as in claim 1, wherein said restraining means includes means for defining a groove in the annular member, the groove for engaging the at least a portion of the wheel.

8. Anti-rotation means as in claim 1, wherein said locking means includes dispersion means for preventing fluid from collecting around said locking means.

9. Anti-rotation means as in claim 1, wherein said annular member further includes dispersion means for preventing fluid from collecting around said locking means.

10. Anti-rotation means as in claim 9, wherein said dispersion means include an axially outer portion of the radially inner surface of the annular member, the axially outer portion of the radially inner surface having a taper with an increasing radius from a point on an axially inner portion of the radial inner surface to an axial end of the annular member.

11. Anti-rotation means as in claim 9, wherein said dispersion means include an axially outer portion of the radially inner surface of the annular member, the axially outer portion of the radially inner surface defining a portion of the side of a frustum of a cone.

12. Anti-rotation means as in claim 1, further comprising spacer means coupled to said annular member for axially spacing said annular member from the wheel.

13. In an axial fluid flow turbine, a rotor comprising:

a rotatable shaft having a first surface with a first predetermined axial expanse, the first peripheral surface for irrotatably receiving a first wheel, the shaft further having a second peripheral surface with a second predetermined wherein the shaft further includes a pair of circumferential grooves each of the grooves disposed into the periphery of the shaft and intersecting a respective end of the second peripheral surface locking mmeans discrete from yet irrotatably affixed to the second peripheral surface fo the shaft; said locking means including an annular member having a radially inner surface for irrotatably engaging the second peripheral surface, and further wherein the radially inner surface of the annular member extends axially beyond the respective intersections of the second peripheral surface with the pair of circumferential grooves; and, restraining means affixed to said locking means, said restraining means for fixedly engaging a portion of the first wheel, whereby rotation of the first wheel with respect to the shaft is prevented.

14. The rotor as in claim 13, wherein said rotatable shsft includes a third peripheral surface having a third predetermined axial expanse, the third peripheral surface for irrotatably receiving a second wheel, the second peripheral surface disposed between the first and third peripheral surface, and further wherein said restraining means for fixedly engaging at least a portion of the second wheel, whereby rotation of the second wheel with respect to the shaft and with respect to the first wheel is prevented.

15. The rotor as in claim 13, wherein said annular member further includes dispersion means for preventing fluid from collecting around said locking means.

16. The rotor as in claim 15, wherein said dispersion means include an axially outer portion of the radially inner surface of the annular member, the axially outer portion of the radial inner surface having a contour for directing fluid axially beyond at least one axial end of the annular member when the rotor is rotating.

17. The rotor as in claim 15, wherein said dispersion means include an axially outer portion of the radially inner surface of the annular member, the axially outer portion of the radial inner surface having a taper with an increasing radius from a point on an axially inner portion of the radial inner surface to an axial end of the annular member.

18. The rotor as in claim 17, wherein the point on the axially inner portion of the radial inner surface is disposed between an axial end of the annular member and the proximate intersection of the radial inner surface and one of the pair of grooves.

19. The rotor as in claim 13, further comprising spacer means coupled to said annular member for axially spacing said annular member from the first wheel.

20. The rotor as in claim 13, wherein said restraining means include a first pair of spaced apart ribs coupled to the periphery of said annular member and extending from said annular member, said first pair of ribs for receiving a tab of the first wheel between said first pair of ribs.

21. The rotor as in claim 20, wherein said first pair of ribs radially outwardly extend from said annular member.

22. The rotor as in claim 20, wherein said first pair of ribs axially extend in one axial direction from said annular member.

23. The rotor as in claim 22, further comprising a second pair of spaced apart ribs coupled to the periphery of said annular member, said second pair of ribs axially extending from the annular member in the other axial direction for engaging a portion of another wheel therebetween.

24. The rotor as in claim 23, wherein said first and second pair of tabs are disposed so as not to be axially aligned.

25. The rotor as in claim 13, wherein said restraining means includes means for defining a groove in the annular member, the groove for engaging the at least a portion of the wheel.

26. The rotor as in claim 14, wherein said restraining means include a first pair of spaced apart ribs coupled to the periphery of said annular member and radially outwardly extending from said annular member, said first pair of ribs for receiving a respective tab of the first and second wheel between said first pair of ribs.

27. The rotor as in claim 14, wherein said restraining means include a first pair of spaced apart ribs coupled to and axially extending from said annular member in an axial direction, and a second pair of spaced apart ribs coupled to and axially extending from said annular member in the other axial direction, said first pair of ribs for receiving a tab of the first wheel therebetween and said second pair of ribs for receiving a tab of the second wheel therebetween.

28. The rotor as in claim 27, wherein said first and second pair of tabs are disposed so as not to be axially aligned.

29. The rotor as in claim 13, wherein said restraining means includes means for defining a first groove in the annular member for engaging a portion of the first and/or second wheel.

30. The rotor as in claim 29, wherein the first groove radially extends and further wherein said restraining means further comprises means for defining a second radially extending groove for engaging a portion of the second wheel.

* * * * *